US005513915A

United States Patent [19]

May

[11] Patent Number: 5,513,915

[45] Date of Patent: May 7, 1996

[54] CLOSURE ARRANGEMENT HAVING A BREAKAWAY SEAL

[75] Inventor: Timothy J. May, Greenville, Wis.

[73] Assignee: Reynolds Consumer Products Inc., Appleton, Wis.

[21] Appl. No.: 443,611

[22] Filed: May 18, 1995

Related U.S. Application Data

[63] Continuation-in-part of Ser. No. 225,866, Apr. 11, 1994, Pat. No. 5,486,051.

[51] Int. Cl.[6] ..... B65D 33/16

[52] U.S. Cl. ..... 383/210; 383/61

[58] Field of Search ..... 383/4, 210, 211, 383/200, 61

[56] References Cited

U.S. PATENT DOCUMENTS

| | | | |
|---|---|---|---|
| 3,256,981 | 6/1966 | Kurtz | 206/56 |
| 3,368,740 | 2/1968 | Rohde | 383/200 |
| 3,535,409 | 10/1970 | Rohde | 383/200 |
| 3,625,270 | 12/1971 | Skenzic | 383/61 |
| 3,655,503 | 4/1972 | Stanley et al. | 161/165 |
| 3,711,011 | 1/1973 | Kugler | 229/7 R |
| 4,522,305 | 6/1985 | Jacobsson | 206/632 |
| 4,638,913 | 1/1987 | Howe, Jr. | 206/632 |
| 4,855,168 | 8/1989 | Imaizumi | 383/200 |
| 4,875,587 | 10/1989 | Lulham et al. | 206/484 |
| 4,889,731 | 12/1989 | Williams, Jr. | 426/106 |
| 4,925,318 | 5/1990 | Sorensen | 383/63 |
| 4,944,409 | 7/1990 | Busche et al. | 206/632 |
| 4,969,967 | 11/1990 | Sorensen et al. | 156/66 |
| 5,063,069 | 11/1991 | Von Erden et al. | 383/61 |
| 5,224,779 | 7/1993 | Thompson et al. | 383/5 |

*Primary Examiner*—Stephen P. Garbe
*Attorney, Agent, or Firm*—Alan T. McDonald

[57] ABSTRACT

A closure arrangement for a polymeric bag having first and second opposing films comprises first and second opposing base strips, a post, and an L-shaped breakaway member. The first base strip has an inner and outer surface, and the outer surface of the first base strip is adapted for attachment to the first film. The second base strip has an inner and outer surface, and the outer surface of the second base strip is adapted for attachment to the second film. The post is generally perpendicular to the first base strip. The L-shaped breakaway member has first and second legs. The first leg is generally parallel to and substantially co-planar with the first base strip. The first leg has opposing inner and outer surfaces and opposing upper and lower sides extending between the inner and outer surfaces. The inner surface of the first leg is adapted for attachment to the second film. The second leg is generally perpendicular to the first leg and joined to the first leg in close proximity to one of the upper and lower sides. The post extends inwardly from the inner surface of the first base strip adjacent to the second leg. The second leg and the one of the upper and lower sides of the first leg is detachably connected to the respective post and the first base strip to form a breakaway seal.

14 Claims, 3 Drawing Sheets

CLOSURE ARRANGEMENT HAVING A BREAKAWAY SEAL

This is a continuation-in-part of U.S. application Ser. No. 08/225866, filed Apr. 11, 1994, now U.S. Pat. No. 5,486,051.

FIELD OF THE INVENTION

The present invention generally relates to closure arrangements for polymeric (plastic) bags and, more particularly, relates to a closure arrangement having a breakaway seal which provides a consistent hermetic seal, which allows for quick and easy access to the contents of the bag, and which is relatively insusceptible to small manufacturing variations.

DESCRIPTION OF THE PRIOR ART

In many consumer packaging applications, it is important to prevent air or water or the like from passing out of or into a package containing certain products. This is particularly true with respect to meat packages, cheese packages, and the like, for which the contained product must be kept in a constant environment to prevent spoilage. In order to preserve the product contained within such a package, the periphery of the package must be hermetically sealed. Hermetic seals can be provided by both permanent seals and temporary seals known as peelable seals. Peelable seals are capable of providing a hermetic seal and, at the same time, providing a consumer with access to the contents of a package. A consumer breaks a peelable seal of a package by first grabbing onto opposing film faces to which peelable seal materials are adhered and then pulling the film faces apart. To provide a peelable seal on a package with a reclosable zipper, the package typically uses permanent seals at its side edges and bottom edge and a peelable seal above or below the reclosable zipper at the mouth end of the package. In addition, the peelable seal may be arranged on either the flange/base portions of the zipper or on the packaging film adjacent to the flange portions.

Typically, one sealing station is used to seal all the edges of a package and, at the same time, make a peelable seal from a strip of peelable materials. The sealing station has a set of seal bars, protruding from a sealing head, which press the package edges and the peelable strip against a resilient backing, such as rubber, to form both the permanent edge seals and the peelable seal. The strength of the seals is determined by the temperature, pressure, and dwell time of the seal bars.

The above process is slightly modified when a reclosable zipper is inserted at the mouth end of the package between the top and bottom films of the package, and a peelable seal is to be located above or below the zipper. In that situation, the package typically reaches the sealing station with the zipper adhered to only the bottom film. The sealing station has a seal bar for (1) adhering the top film to a flange portion of the zipper and (2) creating the peelable seal.

There are a couple of typical approaches for forming peelable seals on reclosable packages having a top and bottom film. One typical approach adheres a multilayered film to each of the opposing inner surfaces of the packaging film (or zipper flange portions) along the length of the mouth end of the package. This results in a first multilayered film on the inner surface of the top film and a second multilayered film on the inner surface of the bottom film. A peelable seal is formed by heat sealing the first and second multilayered films to one another. When a consumer breaks the peelable seal, one or more layers of the second multilayered film will disengage from the other layers of the second multilayered film and remain adhered to the first multilayered film. As a result, the first multilayered film will include at least one additional layer when the peelable seal is broken. The above layer disengagement upon breaking the peelable seal is accomplished by using film layers composed of different polymeric materials and by exploiting the varying bond strengths between the layers.

Another typical approach adheres a layer of film to each of the opposing inner surfaces of the packaging film (or zipper flange portions) and introduces contaminants to one or both of the film layers. The peelable seal is formed by heat sealing the contaminated layers to one another. The peelable seal results from a weakened bond being formed between the contaminated layers due to the surface contamination. Breaking the peelable seal detaches the layers from one another.

The foregoing approaches for forming peelable seals suffer from several drawbacks. One drawback is that the peelable seals are highly susceptible to small variations which might occur during manufacture, i.e., the peelable seals have low manufacturing tolerances. For example, slight variations in the temperature, pressure, or dwell time of the seal bar forming the peelable seal might create a peelable seal which is either too weak or too strong. An excessively weak peelable seal might not provide a hermetic seal, while an excessively strong peelable seal might be difficult for a consumer to break. Thus, the low manufacturing tolerances of the peelable seals leads to unpredictability and nonuniformity in the bond strength provided by the peelable seals.

Since the peelable seals are highly susceptible to small manufacturing variations, a related drawback of the foregoing approaches for forming peelable seals is that the peelable seals do not consistently break in the same manner from bag to bag. For instance, breaking a peelable seal on one bag might detach only one layer of the multilayered film, while breaking a peelable seal on another bag might detach more than one layer of the multilayered film.

Consequently, a need exists for a closure arrangement for a polymeric bag which overcomes the aforementioned shortcomings associated with existing peelable seals.

SUMMARY OF THE INVENTION

Accordingly, an object of the present invention is to provide a closure arrangement for a polymeric bag having a breakaway seal which provides a hermetic seal and, at the same time, can be quickly and easily broken.

Another object of the present invention is to provide a closure arrangement which is relatively insusceptible to small manufacturing variations.

Yet another object of the present invention is to provide a closure arrangement having a breakaway seal which is consistent in strength from one bag to the next and which breaks consistently from one bag to the next.

In presently preferred embodiments, these and other objects are realized by providing a closure arrangement for a polymeric bag having first and second opposing films, the closure arrangement comprising first and second opposing base strips, a post, and an L-shaped breakaway member. The first base strip has an inner and outer surface, and the outer surface of the first base strip is adapted for attachment to the first film. The second base strip has an inner and outer surface, and the outer surface of the second base strip is adapted for attachment to the second film. The post is generally perpendicular to the first base strip. The L-shaped breakaway member has first and second legs. The first leg is generally parallel to and substantially co-planar with the first base strip. The first leg has opposing inner and outer surfaces and opposing upper and lower sides extending between the inner and outer surfaces. The inner surface of the first leg is adapted for attachment to the second film. The second leg is generally perpendicular to the first leg and joined to the first leg in close proximity to one of the upper and lower sides. The post extends inwardly from the inner surface of the first base strip adjacent to the second leg. The second leg and the one of the upper and lower sides of the first leg is detachably connected to the respective post and the first base strip to form a breakaway seal.

The above summary of the present invention is not intended to represent each embodiment, or every aspect, of the present invention. This is the purpose of the Figures and the detailed description which follow.

BRIEF DESCRIPTION OF THE DRAWINGS

Other objects and advantages of the invention will become apparent upon reading the following detailed description and upon reference to the drawings in which.

Figure 1:
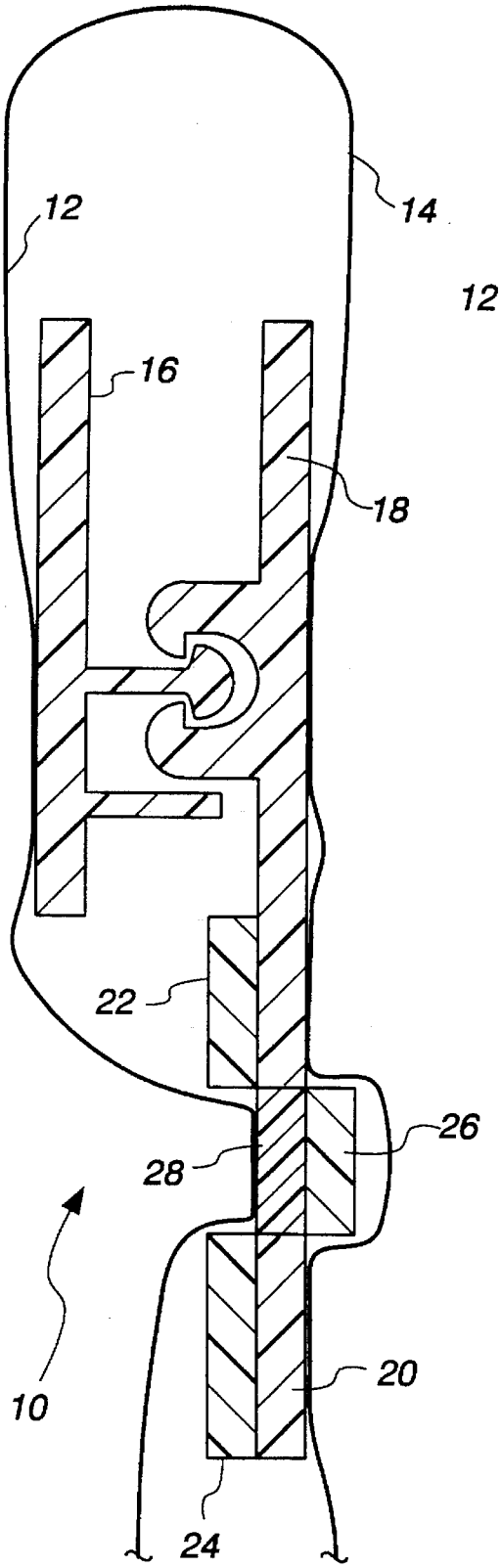
FIG. 1 is a sectional view of a first embodiment of a closure arrangement embodying the present invention, showing a breakaway seal prior to being broken.

While the invention is susceptible to various modifications and alternative forms, specific embodiments thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
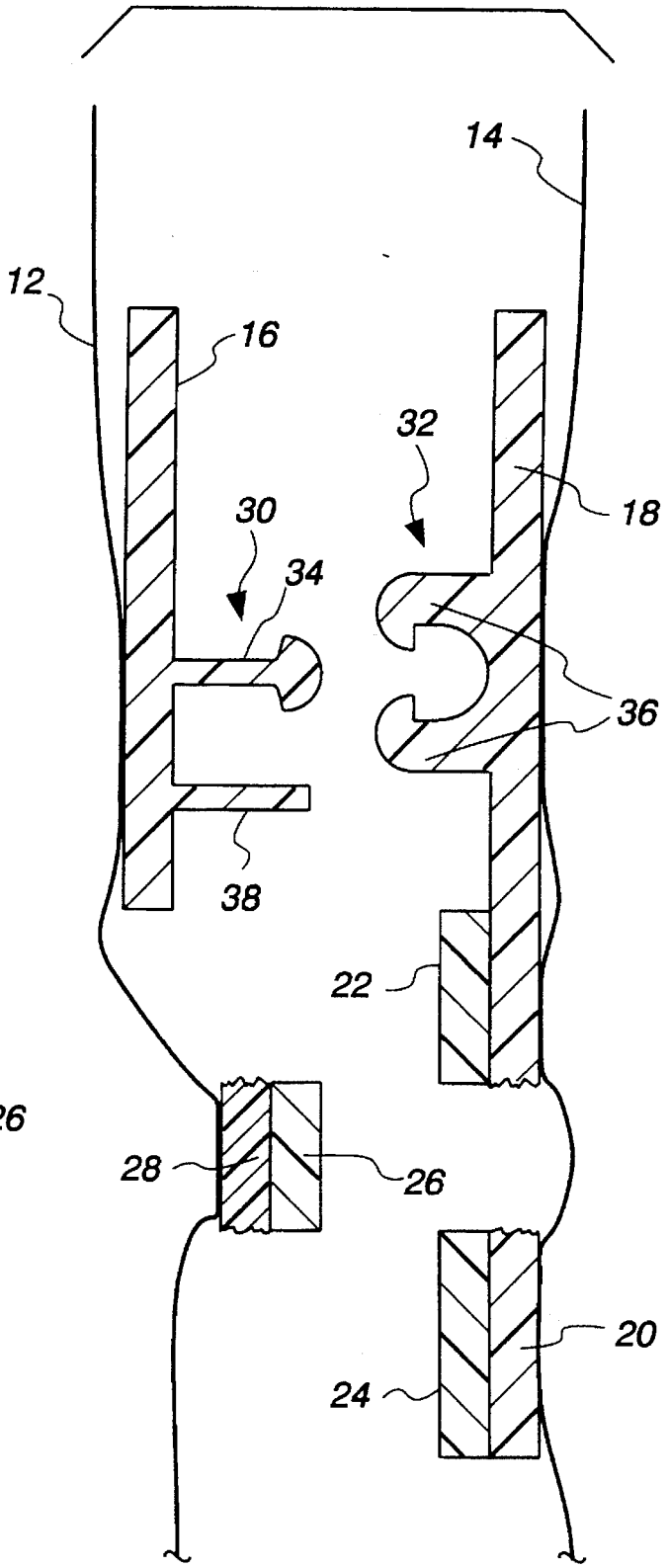
FIG. 2 is a sectional view of the closure arrangement in FIG. 1, showing the breakaway seal after being broken.

Turning now to the drawings, FIGS. 1 and 2 illustrate a sectional view of a closure arrangement 10 for a reclosable bag having a top film 12 and a bottom film 14. The closure arrangement 10 includes a plurality of flat base strips 16, 18, and 20, a plurality of flat non-sealant strips 22, 24, and 26, and a flat breakaway strip 28. The strips 16–28 are disposed at the mouth of the reclosable bag and extend along the length of the bag mouth. Moreover, the strips 16–28 are parallel to each other along the length of the bag mouth. The top film 12 is heat-fused to the outer surface of the base strip 16 and to the breakaway strip 28, while the bottom film 14 is heat-fused to the outer surfaces of the base strip 18 and the base strip 20.

The base strips 18, 20 have approximately the same thickness, are co-planar with each other, and are laterally spaced from each other by a distance equivalent to the width of the breakaway strip 28. As viewed in FIGS. 1 and 2, the width of the breakaway strip 28 is equal to the vertical dimension thereof. An upper flange portion of the base strip 18 directly opposes the base strip 16.

To provide the closure arrangement 10 with a reclosable zipper, the base strips 16, 18 have integrally formed therewith respective male and female closure profiles 30, 32. The male closure profile 30 extends inwardly from the inner surface of the base strip 16 and includes a single locking member 34 with an expanded head. The female closure-profile 32 extends inwardly from the upper flange portion of the base strip 18 and includes a pair of flexible locking members 36 with hooks at the ends thereof. The pair of locking members 36 are disposed opposite the single locking member 34 and are spaced by a sufficient distance that the expanded head of the single locking member 34 is releasably engageable between the pair of locking members 36. More specifically, the pair of locking members 36 interlock with the locking member 34 in a snapping action caused by bringing the hooks of the pair of locking members 36 past the-expanded head of the locking member 34. To facilitate alignment of the pair of locking members 36 with the locking member 34 during reclosure, the male closure profile 30 is provided with a guide post 38 for guiding one of the pair of locking members 36 between the guide post 38 and the locking member 34. In an alternative embodiment, the closure arrangement 10 is designed without a reclosable zipper.

The breakaway strip 28 preferably has approximately the same thickness of the base strips 18, 20 and is co-planar with the base strips 18, 20. However, if desired to provide varying breakaway properties, the breakaway strip 28 may have a thickness substantially greater than or substantially less than the base strips 18, 20. The breakaway strip 28 is disposed between the spaced base strips 18, 20 and is releasably engaged thereto so as to form breakaway seals at the junctions between the breakaway strip 28 and the respective base strips 18, 20. More specifically, an upper side of the breakaway strip 28 is detachably connected to the base strip 18 to form a first breakaway seal and the opposing lower side of the breakaway strip 28 is detachably connected to the base strip 20 to form a second breakaway seal. To permit these breakaway seals to be broken as depicted in FIG. 2, the inner surface of the breakaway strip 28 is directly attached to the top film 12.

In an alternative embodiment, the breakaway strip 28 is attached to the top film 12 using a sealant strip disposed therebetween. Since the sealant strip bonds readily to other materials at low temperatures, the sealant strip acts as a bridge for attaching the top film 12 to the breakaway strip 28. The sealant strip preferably is a mixture of low density polyethylene and ethylene vinyl acetate, such as VE 652059 manufactured by Quantum Chemical Corp. of Cincinnati, Ohio. This mixture allows the sealant material to seal at lower temperatures than low density polyethylene by providing the sealant material with a melting point ranging from 175° F. to 205° F.

In a second alternative embodiment, the base strip 20 and non-sealant strip 24 are eliminated. In this embodiment, the breakaway strip 28 is detachably connected only to base strip 18.

The non-sealable strips 22, 24, and 26 are composed of a heat-resistant material. The non-sealable strips 22, 24 insure that the top film 12 is only fused to the breakaway strip 28 by preventing attachment of the top film 12 to adjacent portions of the base strips 18, 20. The non-sealable strip 22 is attached to the inner surface of the base strip 18 adjacent the upper side of the breakaway strip 28, while the non-sealable strip 24 is attached to the inner surface of the base strip 20 adjacent the lower side of the breakaway strip 28. The non-sealable strip 26 insures that the bottom film 14 is only fused to the base strips 18, 20 by preventing attachment of the base film 14 to the breakaway strip 28. The non-sealable strip 26 is disposed between the outer surface of the breakaway strip 28 and the bottom film 14 and is attached to the outer surface of the breakaway strip 28. In the embodiment where strips 20 and 24 are not present, top film 12 and bottom film 14 are prevented from fusing by the use of seal bars that do not protrude below breakaway strip 28.

As shown in FIG. 1, prior to initially opening a bag incorporating the closure arrangement 10, the breakaway seals are intact, the closure profiles 30, 32 are interlocked with each other, and the top and bottom films 12, 14 are connected at the mouth end of the bag. The top and bottom films 12, 14 either are heat-fused together at the mouth end of the bag or are formed from a single piece of film. Since the breakaway seals between the breakaway strip 28 and the base strips 18, 20 already provide a hermetic seal for the bag, the top and bottom films 12, 14 may alternatively be disconnected from each other at the mouth end.

To open the bag, the top and bottom films 12, 14 are separated from each other by cutting them apart. Next, the interlocked closure profiles 30, 32 are detached from each other by grabbing onto the top and bottom films 12, 14 and pulling them apart. Finally, the breakaway seals between the breakaway strip 28 and the base strips 18, 20 are broken by continuing to pull the top and bottom films 12, 14 in opposite directions. During breakage of these breakaway seals, the base strip 16 and the breakaway strip 28 remain attached to the top film 12, while the base strips 18, 20 remain attached to the bottom film 14.

The closure arrangement 10 is manufactured using conventional extrusion and heat sealing techniques. In particular, the base strips 16, 18, and 20, the closure profiles 30, 32, the non-sealable strips 22, 24, and 26, and the breakaway strip 28 are co-extruded through a die plate fed by a plurality of extruders. These extruders carry the different molten materials for forming the strips 16–28 and the closure profiles 30, 32. As is well-known in the art, the die plate includes input ports, output ports, and channels connecting these input ports to output ports. The extruders feed the different molten materials to different input ports, and the channels are designed to configure the molten materials into the shapes of the strips 16–28 and the closure profiles 30, 32. The output ports are arranged such that the strips 16–28 and the closure profiles 30, 32 exit the die plate with the connections shown in FIG. 1. Since the base strip 16 and the male closure profile 30 are separated from the base strips 18, 20, the non-sealable strips 22, 24, and 26, the breakaway strip 28, and the female closure profile 32, it should be apparent that these two separate sets of elements may be formed in separate extrusions using two different die plates.

After extruding the strips 16–28 and the closure profiles 30, 32, the top and bottom films 12, 14 are heat-fused using heated seal bars in the positions shown in FIG. 1. In particular, the top film 12 is heat-fused to the base strip 16 and the breakaway strip 28, and the bottom film 14 is heat-fused to the base strips 18, 20 at the illustrated positions. The vertical dimension (as viewed in FIG. 1) of the heat-fused positions is determined by the width of the seal bars applying pressure to the top and bottom films 12, 14.

Due to the interposition of the non-sealable strips 22, 24 between the top film 12 and the respective base strips 18, 20 at locations adjacent the breakaway strip 28, the closure arrangement 10 accommodates a wider seal bar for fusing the top film 12 to the breakaway strip 28. Although the wider seal bar may increase the temperature of the top film 12 and the base strips 18, 20 at locations adjacent the breakaway seal 28, the non-sealable strips 22, 24 prevent the top film 12 from improperly fusing to the inner surfaces of the base strips 18, 20 at these locations. Similarly, the interposition of the non-sealant strip 26 between the breakaway strip 28 and the bottom film 14 allows the application of heat to the bottom film 14 at locations immediately adjacent the breakaway strip 28 without improperly fusing the bottom film 14 to the breakaway strip 28.

The closure arrangement 10 is also relatively insusceptible to slightly misaligned seal bars during production. For example, the seal bar for fusing the top film 12 to the breakaway strip 28 should be centrally aligned with the breakaway strip 28, and the seal bars for fusing the bottom film 14 to the base strips 18, 20 should contact the base film 14 at locations slightly above and slightly below the breakaway strip 28. If, however, these seal bars are slightly misaligned relative to the preferred contact locations, the non-sealable strips 22, 24 prevent the top film 12 from forming any bonds to the base strips 18, 20 and the non-sealable strip 26 prevents the bottom film 14 from forming any bond to the breakaway strip 28.

During manufacture of the closure arrangement 10, the various bonds or attachments between different materials are formed such that the weakest bond is formed at the locations of the breakaway seals. By forming the weakest bond at the locations of the breakaway seals, the application of opening forces to the closure arrangement 10 will cause the breakaway seals to rupture first. Since the other bonds are stronger than the breakaway seal, these other bonds will not rupture in response to the application of opening forces.

The closure arrangement 10 is designed to facilitate control of the strength of the breakaway seals formed between the breakaway strip 28 and the respective base strips 18, 20. In particular, the strength of the breakaway seals is primarily determined by the composition of the materials forming the base strips 18 and 20 and the breakaway strip 28 and the thickness of both the breakaway strip 28 and the base strips 18, 20. The thicker the breakaway strip 28 and the base strips 18, 20, the larger the horizontal dimension (as viewed in FIGS. 1 and 2) of the breakaway seals and, therefore, the stronger the breakaway seals. In the preferred embodiment, the breakaway seals have a combined strength ranging from about two to about six pounds per lineal inch. This lineal inch is measured along the length of the breakaway seals, i.e., perpendicular to the plane of FIGS. 1 and 2 at the location of the breakaway seals. It has been discovered that a seal strength within this range allows the breakaway seals to hermetically seal the associated bag and, at the same time, allows the breakaway seals to be quickly and easily broken.

All other bonds which are stressed while breaking the breakaway seals preferably have a strength of at least about ten pounds per lineal inch. These stressed bonds are those which involve the top and bottom films 12, 14; namely, the bond between the top film 12 and the base strip 16, the bond between the top film 12 and the breakaway strip 28, the bond between the bottom film 14 and the base strip 18, and the bond between the bottom film 14 and the base strip 20. This difference in bond strength between the breakaway seals and the aforementioned stressed bonds insures that only the breakaway seals will break in response to opening the closure arrangement 10.

As described above, the breakaway seals between the breakaway strip 28 and the base strips 18, 20 are formed by co-extruding the breakaway strip 28 with the base strips 18, 20, as opposed to being formed during the heat sealing operation. As a result, the temperature, pressure, and dwell time of the heated seal bars have minimal effect upon the formation and strength of the breakaway seals. This, in turn, makes the breakaway seals relatively insusceptible to small variations in the temperature, pressure, and dwell time of the heated seal bars during the heat sealing operation.

Thus, the breakaway seals are consistent in strength from one bag to the next. In addition, they break in a consistent manner from one bag to the next. To provide evidence of tampering, breaking the breakaway seals of the closure arrangement 10 causes the breakaway seals to undergo a change in texture or appearance. This change in texture or appearance provides the consumer with a visual indication that the breakaway seals have been broken.

The preferred compositions of the various strips of the closure arrangement 10 are described below. The materials used to create the breakaway seal rely on a property of the co-extrusion process. When materials are co-extruded, their interface forms a bond that is lower in strength than the materials themselves due to incompatibility of the materials being co-extruded. Thus, by co-extruding the base strips 18 and 20 of a first material and the breakaway strip 28 of a second material, the bond along the lines between base strip 18 and breakaway strip 28 and between base strip 20 and breakaway strip 28 are weaker than any of the materials forming base strips 18 and 20 and breakaway strip 28.

The breakaway strip 28 is most preferably formed from a mixture of four components. First, the breakaway material includes a low density polyethylene, such as Product No. 412FA manufactured by Westlake Polymers Corp. of Lake Charles, La. Second, the breakaway material includes a mineral-reinforcement concentrate, such as HM10 manufactured by Heritage Plastics Inc. of Picayune, Miss. Third, the breakaway material includes ethylene vinyl acetate (EVA), such as ESCORENE® manufactured by Exxon Chemical Co. of Baytown, Tex. Finally, the breakaway material includes polybutylene, such as Shell 1560 manufactured by Shell Oil Co. of Houston, Tex. The weight percentages of the foregoing four components of the breakaway material preferably are 30% low density polyethylene, 30% mineral-reinforcement concentrate, 20% ethylene vinyl acetate, and 20% polybutylene. The foregoing mixture allows the breakaway material to achieve its desired characteristics, which include (1) the ability to provide a bond strength between two and six pounds per linear inch, and (2) the ability to be heat sealed to the top film 12 using a heated seal bar having a temperature ranging from about 300° F. to 400° F. and a dwell time ranging from about 0.3 to 0.7 seconds.

The base material used to form the base strips 16, 18, and 20 and the closure profiles 30, 32 is preferably composed of a mixture of two components. First, the base material includes a low density polyethylene, such as Product No. 412FA manufactured by Westlake Polymers Corp. of Lake Charles, La. Second, the base material includes ethylene vinyl acetate, such as ESCORENE® manufactured by Exxon Chemical Co. of Baytown, Tex. The preferred weight percentages are 90% low density polyethylene and 10% ethylene vinyl acetate. Alternatively, the base material may be composed of Rexene 1206 manufactured by Rexene Corporation of Odessa, Tex. The primary characteristics of the base material are that it bonds readily to the breakaway material of the breakaway strip 28 in the manner discussed above and it provides a modicum of thermal resistance so that it does not melt while bonding other materials thereto.

The non-sealable material used to form the non-sealable strips 22, 24, and 26 is a heat-resistant material such as polypropylene, nylon, or high density polyethylene.

The top and bottom films 12, 14 are preferably composed of two or more layers of material. The outer layer of material is a heat-resistant material such as polyethylene terephthalate (PET), oriented polypropylene, or biaxially-oriented nylon. The inner layer of material is a sealant material such as a combination of low density polyethylene and ethylene vinyl acetate.

Figure 3:
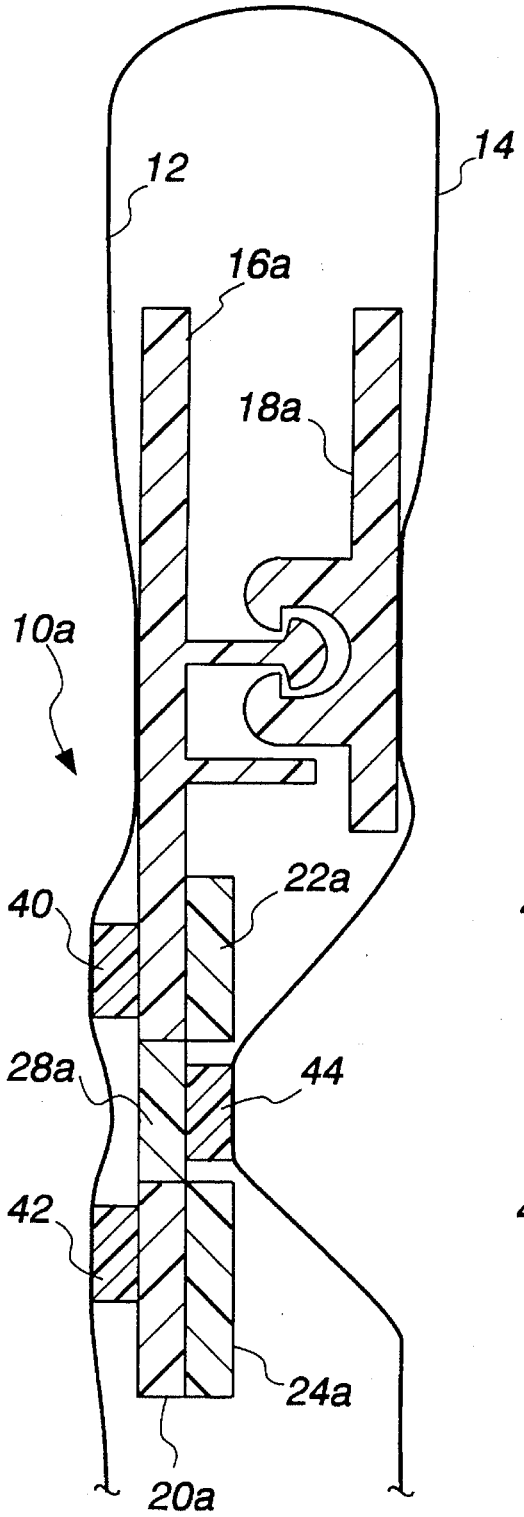
FIG. 3 is a sectional view of a second embodiment of a closure arrangement embodying the present invention, showing a breakaway seal prior to being broken.
Figure 4:
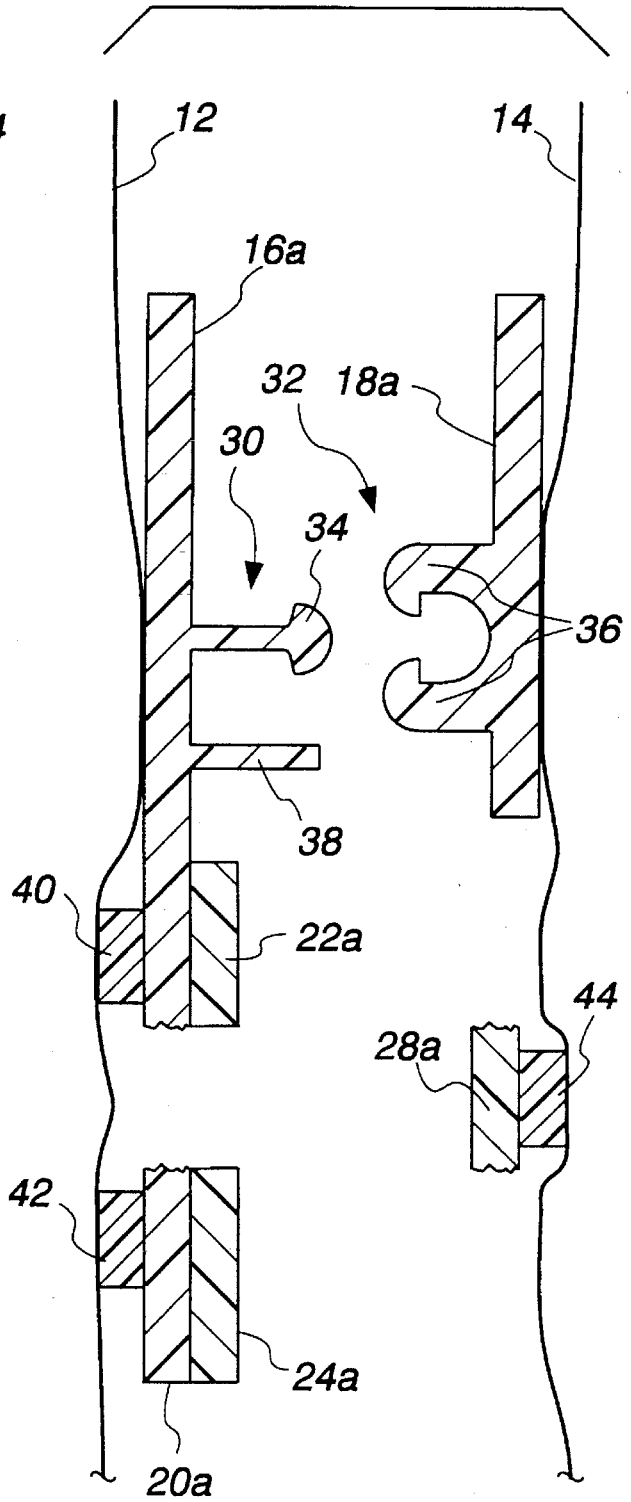
FIG. 4 is a sectional view of the closure arrangement in FIG. 3, showing the breakaway seal after being broken.

FIGS. 3 and 4 illustrate a sectional view of a second closure arrangement **10*a* for a reclosable bag having a top film 12 and a bottom film 14. The closure arrangement 10*a* includes a plurality of flat base strips 16*a*, 18*a*, and 20*a*, a plurality of flat non-sealant strips 22*a* and 24*a*, a plurality of sealant strips 40, 42 and 44, and a flat breakaway strip 28*a*. The top film 12 is heat-fused to the outer surface of the base strip 16*a* and to the sealant strips 40 and 42, while the bottom film 14 is heat-fused to the outer surfaces of the base strip 18*a* and the sealant strip 44. The breakaway strip 28*a* is disposed between the spaced base strips 16*a*, 20*a* and is releasably engaged thereto so as to form breakaway seals at the junctions between the breakaway strip 28 and the respective base strips 16*a*, 20*a*. More specifically, an upper side of the breakaway strip 28 is detachably connected to the base strip 16*a* to form a first breakaway seal and the opposing lower side of the breakaway strip 28 is detachably connected to the base strip 20*a* to form a second breakaway seal. To permit these breakaway seals to be broken as depicted in FIG. 4, the inner surface of the breakaway strip 28 is indirectly attached to the bottom film 14 through sealant strip 44**.

To open the bag, the top and bottom films 12, 14 are separated from each other by cutting them apart. Next, the interlocked closure profiles 30, 32 are detached from each other by grabbing onto the top and bottom films 12, 14 and pulling them apart. Finally, the breakaway seals between the breakaway strip 28 and the base strips **16*a*, 20*a* are broken by continuing to pull the top and bottom films 12, 14 in opposite directions. During breakage of these breakaway seals, the base strip 16*a* and the base strip 20*a* remain attached to the top film 12, while the base strip 18*a* and the breakaway strip 28*a* remain attached to the bottom film 14. In this embodiment, the breakaway strip 28*a* is formed from the same heat resistant materials as strips 22*a* and 24*a***.

The embodiment of FIGS. 3 and 4 also illustrate an alternative that may be used in the FIGS. 1 and 2 embodiment. The sealant layers 40, 42 and 44 are formed of a material that will readily bond with the material forming the inner surfaces of films 12 and 14, such as ethylene vinyl acetate (EVA), with the base strips 16, 18 and 20 being formed of less expensive low density polyethylene. This permits heat sealing of the bag at temperatures lower than otherwise possible with other materials, such as heat sealing polyethylene to polyethylene.

Figure 5:
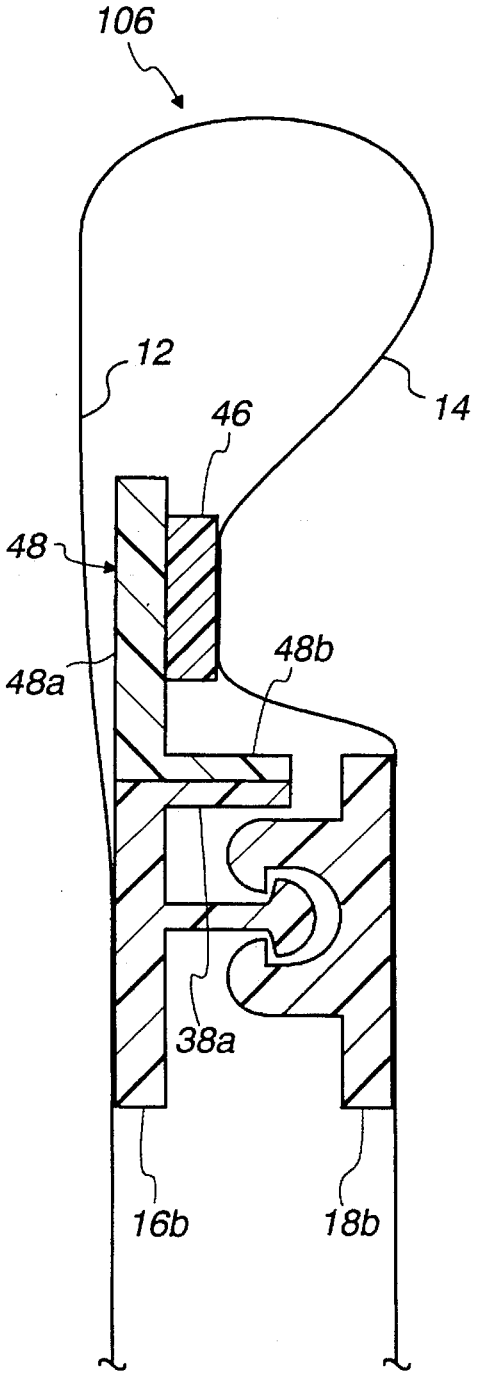
FIG. 5 is a sectional view of a third embodiment of a closure arrangement embodying the present invention, showing a breakaway seal prior to being broken.
Figure 6:
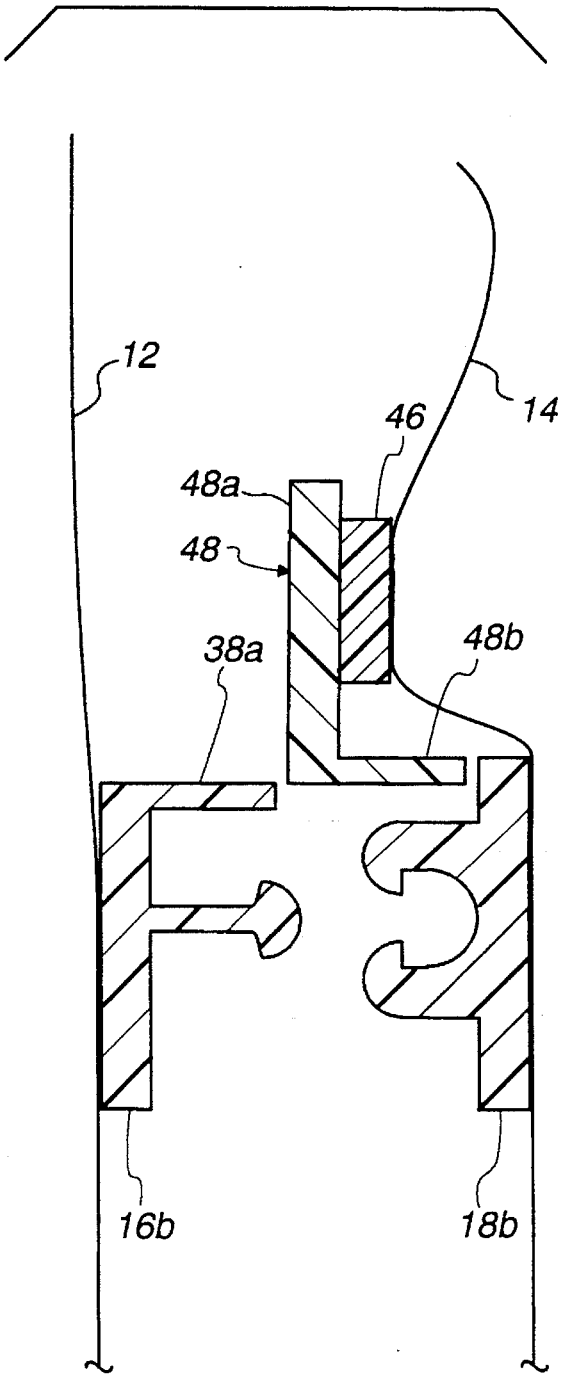
FIG. 6 is a sectional view of the closure arrangement in FIG. 5, showing the breakaway seal after being broken.

FIGS. 5 and 6 illustrate a sectional view of a third closure arrangement **10*b* for a reclosable bag having a top film 12 and a bottom film 14. The closure arrangement 10*b* includes a pair of flat base strips 16*b* and 18*b*, a sealant strip 46, and an L-shaped breakaway member 48. The L-shaped breakaway member 48 includes a first leg 48*a*** approximately the same thickness as and generally co-planar with the base strip 16*b*. Additionally, the breakaway member 48 includes a second leg 48*b* perpendicular to the first leg 48*a*. The top film 12 is heat-fused to the outer surface of the base strip 16*b*, while the bottom film 14 is heat-fused to the outer surfaces of the base strip 18*a* and the sealant strip 46.

The L-shaped breakaway member 48 is releasably engaged to both the base strip 16*b* and a post 38*a* of the reclosable zipper. More specifically, a lower side of the first leg 48*a* is detachably connected to an upper side of the base strip 16*b* and a lower side of the second leg 48*b* is detachably connected to an upper side of the post 38*a* so as to form a breakaway seal at the junction between the breakaway member 48 and both the base strip 16*b* and post 38*a*. The strength of this breakaway seal may be adjusted by varying the length (i.e., horizontal dimension in FIGS. 5 and 6) of the second leg 48*b* of the breakaway member 48. Increasing the length of the second leg 48*b* enhances the strength of the breakaway seal. Conversely, decreasing the length of the second leg 48*b* reduces the strength of the breakaway seal. In one embodiment, the second leg 48*b* is removed altogether so that the breakaway member 48 only includes the first leg 48*a*. The lower side of this first leg 48*a* is then detachably connected to an upper side of the base strip 16*b* to form a breakaway seal therebetween. To permit the breakaway seal to be broken as depicted in FIG. 6, the inner surface of the first leg 48*a* of the breakaway member 48 is indirectly attached to the bottom film 14 through sealant strip 46.

The breakaway member 48 may be positioned above or below the base strip 16*b*. If the breakaway member 48 is positioned below the base strip 16*b*, the second leg 48*b* of the breakaway member 48 is, of course, formed at the top of the breakaway member, and the post 38*a* of the male closure profile is positioned below, instead of above, the male locking member to permit detachable connection to the breakaway member.

To open the bag, the top and bottom films 12, 14 are separated from each other by cutting them apart. Next, the breakaway seal between the breakaway member 48 and both the base strip 16*b* and post 38*a* is broken by grabbing onto the top bottom films 12, 14 and pulling them apart. During breakage of this breakaway seal, the base strip 16*b* remains attached to the top film 12, while the base strip 18*b* and the breakaway member 48 remain attached to the bottom film 14. Finally, the interlocked male and female closure profiles of the reclosable zipper are detached from each other by continuing to pull the top and bottom films 12, 14 in opposite directions.

In the embodiment of FIGS. 5 and 6, the sealant layer 46 is composed of a material that will readily bond with the material forming the inner surfaces of films 12 and 14, such as ethylene vinyl acetate (EVA), with the base strips 16*b* and 18*b* and closure profile members being formed of less expensive low density polyethylene. This permits heat sealing of the bag at temperatures lower than otherwise possible with other materials, such as heat sealing polyethylene to polyethylene. The breakaway member 48 is preferably composed of high density polyethylene so that the breakaway seal in FIG. 5 between the breakaway member 48 and both the base strip 16*b* and post 38*a* is weaker than the bond between the sealant strip 46 and the bottom film 14.

While the present invention has been described with reference to several particular embodiments, those skilled in the art will recognize that many changes may be made thereto without departing from the spirit and scope of the present invention. For example, the closure arrangement 10 may be modified either to remove the reclosable zipper or to position the reclosable zipper below, instead of above, the breakaway seal. In the latter situation, the base strip 20 is provided with a lower flange portion with one of the closure profiles attached thereto. The base strip 16, with the other of the closure profiles attached thereto, is then situated directly opposite the lower flange portion of the base strip 20. The following claims set forth the scope of the present invention.

What is claimed is:

1. A closure arrangement for a polymeric bag having first and second opposing films, comprising:

a first base strip having an inner and outer surface, said outer surface of said first base strip being adapted for attachment to the first film; and a breakaway member having a first leg disposed generally parallel to and substantially co-planar with said first base strip, said first leg having opposing inner and outer surfaces and opposing upper and lower sides extending between said inner and outer surfaces, one of said upper and lower sides of said first leg being detachably connected to said first base strip to form a breakaway seal, said inner surface of said first leg being adapted for attachment to the second film, and wherein said breakaway member includes a second leg generally perpendicular to said first leg and joined to said first leg in close proximity to said one of said upper and lower sides, and further including a post generally perpendicular to said first base strip and extending inwardly from said inner surface of said first base strip adjacent to said second leg, said second leg being detachably connected to said post to form part of the breakaway seal.

2. The closure arrangement of claim 1, further including a second base strip opposing said first base strip, said second base strip having an inner and outer surface, said outer surface of said second base strip being adapted for attachment to the second film.

3. The closure arrangement of claim 2, further including a first locking profile extending inwardly from said inner surface of said first base strip and a second locking profile extending inwardly from said inner surface of said second base strip, said first and second locking profiles being releasably engageable so that the bag is reclosable.

4. The closure arrangement of claim 3, wherein one of said first and second locking profiles includes a pair of locking members and the other of said first and second locking profiles includes a single locking member releasably engageable between said pair of locking members.

5. The closure arrangement of claim 1, wherein said breakaway member is composed of a material containing high density polyethylene.

6. The closure arrangement of claim 1, wherein said first base strip is composed of a material containing low density polyethylene.

7. A closure arrangement for a polymeric bag having first and second opposing films, comprising:

a first base strip having an inner and outer surface, said outer surface of said first base strip being adapted for attachment to the first film; and a breakaway member having a first leg disposed generally parallel to and substantially co-planar with said first base strip, said first leg having opposing inner and outer surfaces and opposing upper and lower sides extending between said inner and outer surfaces, one of said upper and lower sides of said first leg being detachably connected to said first base strip to form a breakaway seal, said inner surface of said first leg being adapted for attachment to the second film, further including a sealant strip formed on said inner surface of said first leg of said breakaway member, said sealant strip attaching said first leg to the second film.

8. The closure arrangement of claim 7, wherein said sealant strip is composed of a material containing ethylene vinyl acetate.

9. The closure arrangement of claim 1, wherein said one of said upper and lower sides of said first leg is said lower side of said first leg.

10. A closure arrangement for a polymeric bag having first and second opposing films, comprising:

a first base strip having an inner and outer surface, said outer surface of said first base strip being adapted for attachment to the first film;

a second base strip opposing said first base strip, said second base strip having an inner and outer surface, said outer surface of said second base strip being adapted for attachment to the second film;

a post generally perpendicular to said first base strip; and an L-shaped breakaway member having first and second legs, said first leg being generally parallel to and substantially co-planar with said first base strip, said first leg having opposing inner and outer surfaces and opposing upper and lower sides extending between said inner and outer surfaces, said inner surface of said first leg being adapted for attachment to the second film, said second leg being generally perpendicular to said first leg and joined to said first leg in close proximity to one of said upper and lower sides, said post extending inwardly from said inner surface of said first base strip adjacent to said second leg, said second leg and said one of said upper and lower sides of said first leg being detachably connected to said respective post and said first base strip to form a breakaway seal.

11. The closure arrangement of claim 10, further including a sealant strip formed on said inner surface of said first leg of said breakaway member, said sealant strip attaching said first leg to the second film.

12. The closure arrangement of claim 10, further including a first locking profile extending inwardly from said inner surface of said first base strip and a second locking profile extending inwardly from said inner surface of said second base strip, said first and second locking profiles being releasably engageable so that the bag is reclosable.

13. A method of manufacturing a closure arrangement for a polymeric bag having first and second opposing films, said method comprising the steps of:

forming a first base strip having an inner and outer surface;

forming a breakaway member having a first leg generally parallel to and substantially co-planar with said first base strip, said first leg having opposing inner and outer surfaces and opposing upper and lower sides extending between said inner and outer surfaces;

detachably connecting one of said upper and lower sides of said first leg to said first base strip to form a breakaway seal;

attaching said inner surface of said first leg to the second film; and attaching said outer surface of said first base strip to the first film.

14. The method of claim 13, wherein the step of forming the breakaway member includes forming a second leg generally perpendicular to said first leg and joined to said first leg in close proximity to said one of said upper and lower sides;

further including the step of forming a post generally perpendicular to said first base strip and extending inwardly from said inner surface of said first base strip adjacent to said second leg; and further including the step of detachably connecting said second leg to said post to form part of the breakaway seal.

* * * * *